US006056301A

United States Patent [19]

Berliner et al.

[11] Patent Number: 6,056,301

[45] Date of Patent: May 2, 2000

[54] GOLF BAG HAVING RETRACTABLE WHEELS AND HANDLE

[76] Inventors: Michael Berliner; Mark Tabakin, both of 9 Garnet Ter., Livingston, N.J. 07039

[21] Appl. No.: 09/322,345

[22] Filed: May 28, 1999

[51] Int. Cl.[7] ..... B62B 1/12

[52] U.S. Cl. ..... 280/43.1; 280/655; 280/47.76; 280/DIG. 6

[58] Field of Search ..... 280/646, 652, 280/47.24, 47.26, 47.19, 655, 655.1, DIG. 6, 43.1, 43.17, 43.22, 47.315; 200/315.3

[56] References Cited

U.S. PATENT DOCUMENTS

| | | | |
|---|---|---|---|
| 2,607,676 | 7/1952 | Fieldhouse | 280/DIG. 6 |
| 4,726,597 | 2/1988 | Hichin | 280/DIG. 6 |
| 4,822,071 | 4/1989 | Widegren | 280/646 |
| 4,836,505 | 6/1989 | Catalo | 280/DIG. 6 |
| 5,265,294 | 11/1993 | Dunn | 280/DIG. 6 |
| 5,470,095 | 11/1995 | Bridges | 280/646 |
| 5,478,097 | 12/1995 | Forma | 280/47.26 |
| 5,599,037 | 2/1997 | Spickler | 280/652 |

*Primary Examiner*—Richard M. Camby
*Attorney, Agent, or Firm*—Goldstein & Canino

[57] ABSTRACT

A golf bag having retractable wheels and handle including a golf bag having a peripheral shell extending downwardly therefrom. The peripheral shell has an open lower end. A pair of wheels are retractably disposed within the peripheral shell of the golf bag in a closed orientation. A handle portion is provided having a T-shaped configuration defined by a lower vertical segment and an upper horizontal segment. The lower vertical segment is coupled with respect to the pair of wheels. A spring-locking mechanism selectively locks the handle portion with respect to the pair of wheels.

6 Claims, 2 Drawing Sheets

GOLF BAG HAVING RETRACTABLE WHEELS AND HANDLE

BACKGROUND OF THE INVENTION

The present invention relates to a golf bag having retractable wheels and handle and more particularly pertains to allowing a golf bag to convert into a golf bag with wheels so as to transport golf clubs without carrying.

Most country clubs and other golf courses essentially utilize motorized carts in an effort to speed golfers in the playing of a round of golf. Although some courses do allow golfers to walk the course, either carrying their own bag or using a caddy to carry their bag for them, these same courses also offer the option of the motorized cart, which most of the players still opt for.

In today's exercise crazed world, golfer's are now opting to walk the golf course during their round in order to facilitate a cardiovascular workout. These same golfers do not want to carry their golf bag and clubs. They have the option of attaching the golf bag either to their own manual cart or renting the same from the golf course. These manual golf carts are usually bulky and often clumsy, resulting in added frustration to the golfer. Additionally, if the golfer owns the manual cart, it is usually a storage problem when carrying in the trunk of the vehicle.

The present invention seeks to provide a solution to these problems by providing a golf bag that includes both retractable wheels and a retractable handle incorporated into the golf bag.

The use of golf bags is known in the prior art. More specifically, golf bags heretofore devised and utilized for the purpose of holding golf clubs and allowing for the transport thereof are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,599,037 to Spickler discloses a golf cart with a foldable handle and retractable wheels with the wheels being adjusted by a foot lever. U.S. Pat. No. 4,822,071 to Widegren discloses a golf bag with retractable wheels and legs. U.S. Pat. No. 5,478,097 to Forma discloses a golf bag with retractable wheels utilizing telescopic wheel supports and retaining doors. U.S. Pat. No. 5,470,095 to Bridges discloses a golf bag with wheels capable of being locked or stored.

While these devices fulfill their respective, particular objective and requirements, the aforementioned patents do not describe a golf bag having retractable wheels and handle for allowing a golf bag to convert into a golf bag with wheels so as to transport golf clubs without carrying.

In this respect, the golf bag having retractable wheels and handle according to the present invention substantially departs from the conventional concepts and designs of the prior art, and in doing so provides an apparatus primarily developed for the purpose of allowing a golf bag to convert into a golf bag with wheels so as to transport golf clubs without carrying.

Therefore, it can be appreciated that there exists a continuing need for new and improved golf bag having retractable wheels and handle which can be used for allowing a golf bag to convert into a golf bag with wheels so as to transport golf clubs without carrying. In this regard, the present invention substantially fulfills this need.

SUMMARY OF THE INVENTION

In the view of the foregoing disadvantages inherent in the known types of golf bags now present in the prior art, the present invention provides an improved golf bag having retractable wheels and handle. As such, the general purpose of the present invention, which will be described subsequently in greater detail, is to provide a new and improved golf bag having retractable wheels and handle and method which has all the advantages of the prior art and none of the disadvantages.

To attain this, the present invention essentially comprises a golf bag having a generally rectangular configuration. The golf bag has an open upper end and a closed lower end. The golf bag includes a shoulder strap and a carrying handle. The closed lower end has a peripheral shell extending downwardly therefrom. The peripheral shell has an open lower end. A pair of wheels are retractably disposed within the peripheral shell of the golf bag in a closed orientation. The pair of wheels have an axle disposed therebetween. A shaft is secured to a central portion of the axle and extends upwardly therefrom through an opening in the closed lower end of the golf bag to an interior of the golf bag. The shaft has an open upper end. The shaft has a pair of apertures therethrough in a spaced relationship along a vertically linear axis. A handle portion is provided having a T-shaped configuration defined by a lower vertical segment and an upper horizontal segment. The lower vertical segment is slidably received within the open upper end of the shaft. A spring-locking mechanism comprised of a tubular protrusion is disposed within and extends outwardly of the lower vertical segment of the handle portion for selectively engaging an upper most of the pair of apertures of the shaft in an extended orientation and a lowermost of the pair of apertures in the closed orientation. The spring-locking mechanism includes a release button disposed within an end of the upper horizontal segment of the handle portion whereby depressing the release button will cause the tubular protrusion to move inwardly of the lower vertical segment thereby disengaging one of the pair of apertures to allow the lower vertical segment to slide with respect to the shaft.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf bag having retractable wheels and handle which has all the advantages of the prior art golf bags and none of the disadvantages.

It is another object of the present invention to provide a new and improved golf bag having retractable wheels and handle which may be easily and efficiently manufactured and marketed.

It is a further object of the present invention to provide a new and improved golf bag having retractable wheels and handle which is of durable and reliable construction.

An even further object of the present invention is to provide a new and improved golf bag having retractable wheels and handle which is susceptible of a low cost of manufacture with regard to both materials and labor, and which accordingly is then susceptible of low prices of sale to the consuming public, thereby making such a golf bag having retractable wheels and handle economically available to the buying public.

Even still another object of the present invention is to provide a new and improved golf bag having retractable wheels and handle for allowing a golf bag to convert into a golf bag with wheels so as to transport golf clubs without carrying.

Lastly, it is an object of the present invention to provide a new and improved golf bag having retractable wheels and handle including a golf bag having a peripheral shell extending downwardly therefrom. The peripheral shell has an open lower end. A pair of wheels are retractably disposed within the peripheral shell of the golf bag in a closed orientation. A handle portion is provided having a T-shaped configuration defined by a lower vertical segment and an upper horizontal segment. The lower vertical segment is coupled with respect to the pair of wheels. A spring-locking mechanism selectively locks the handle portion with respect to the pair of wheels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
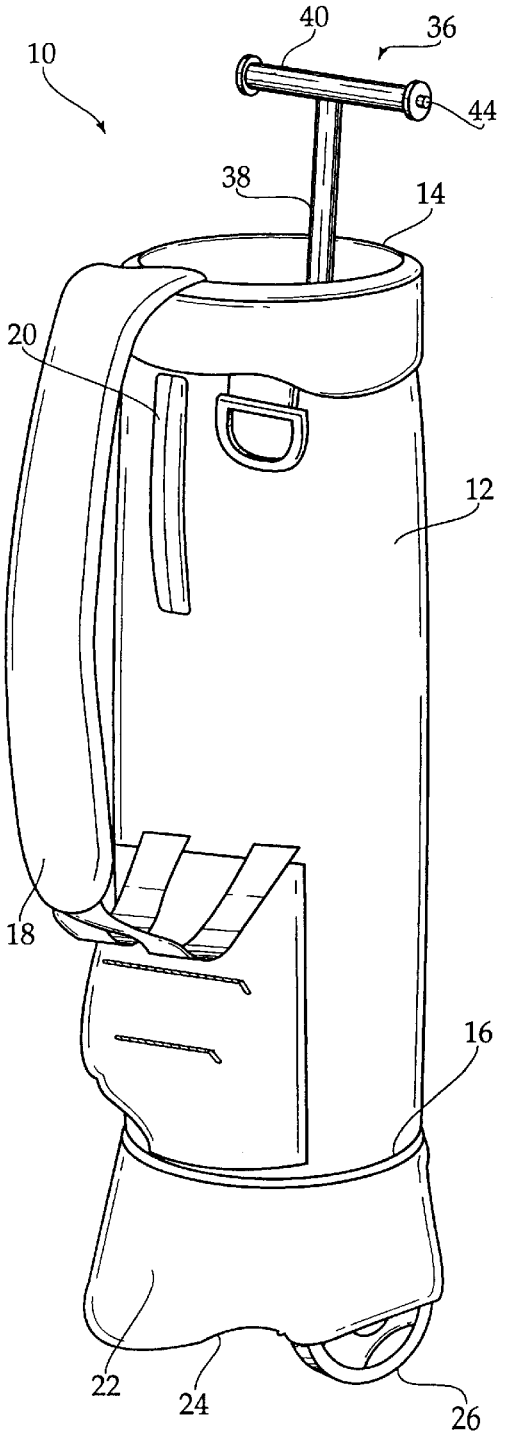
FIG. 1 is a perspective view of the preferred embodiment of the golf bag having retractable wheels and handle constructed in accordance with the principles of the present invention.
Figure 2:
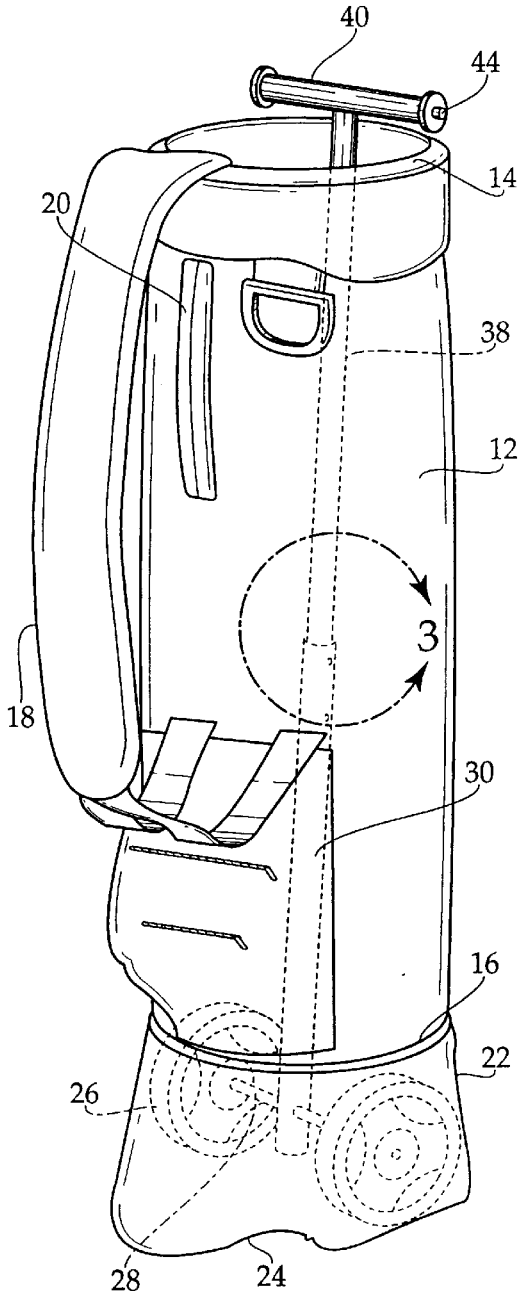
FIG. 2 is a perspective view of the present invention illustrated in a closed orientation.
Figure 3:
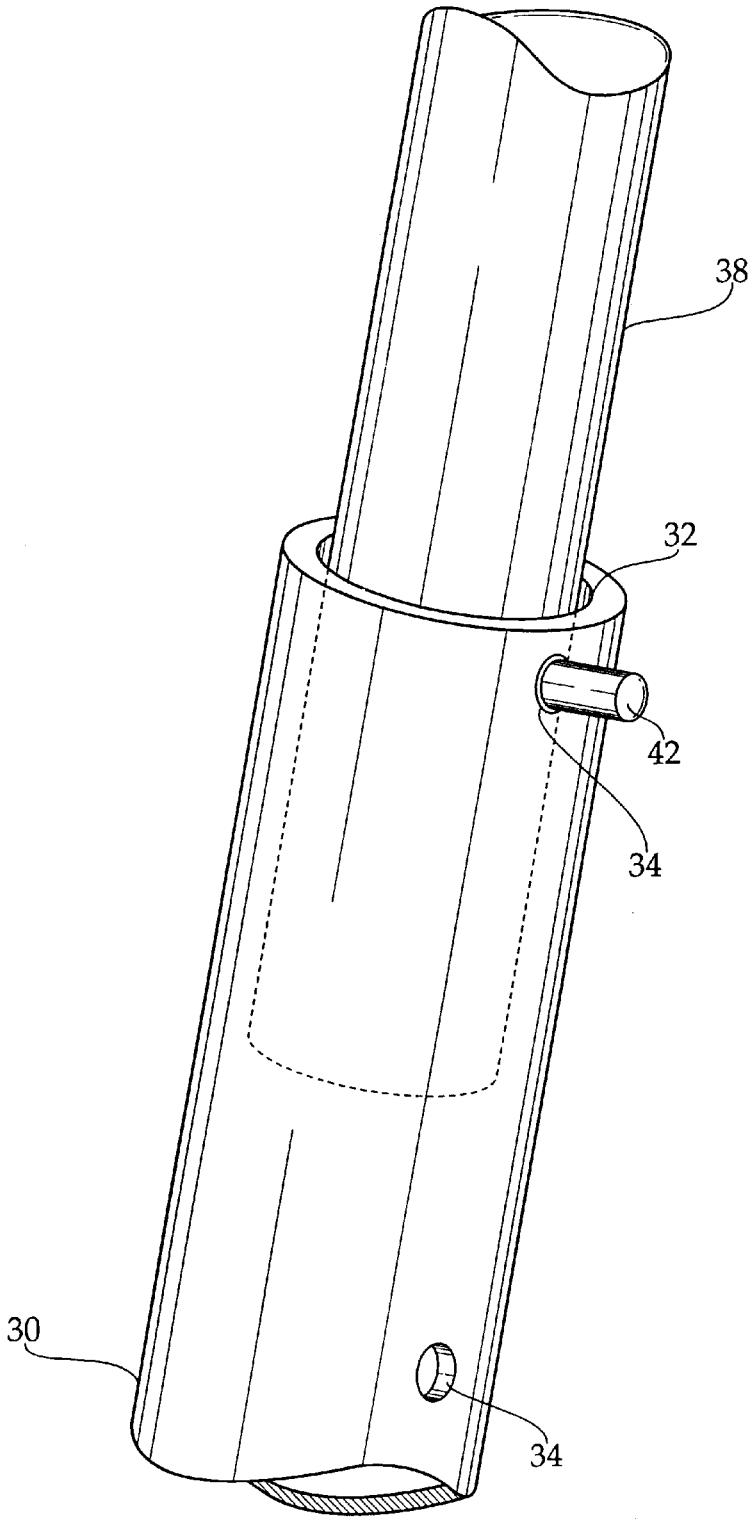
FIG. 3 is a sectional view of the present invention as taken from circle 3 of FIG. 2 illustrating the coupling of the handle to the shaft of the pair of wheels.

With reference now to the drawings, and in particular, to FIGS. 1 through 3 thereof, the preferred embodiment of the new and improved golf bag having retractable wheels and handle embodying the principles and concepts of the present invention and generally designated by the reference number 10 will be described.

Specifically, it will be noted in the various Figures that the device relates to a golf bag having retractable wheels and handle for allowing a golf bag to convert into a golf bag with wheels so as to transport golf clubs without carrying. In its broadest context, the device consists of a golf bag, a pair of wheels, a handle portion, and a spring-locking mechanism. Such components are individually configured and correlated with respect to each other so as to attain the desired objective.

The golf bag 12 has a generally rectangular configuration. Note FIGS. 1 and 2. The golf bag 12 has an open upper end 14 and a closed lower end 16. The open upper end 14 receives golf clubs for carrying within the golf bag 12. The golf bag 12 includes a shoulder strap 18 and a carrying handle 20. The closed lower end 16 has a peripheral shell 22 extending downwardly therefrom. The peripheral shell 22 has an open lower end 24.

The pair of wheels 26 are retractably disposed within the peripheral shell 22 of the golf bag 12 in a closed orientation. The pair of wheels 26 have an axle 28 disposed therebetween. A shaft 30 is secured to a central portion of the axle 28 and extends upwardly therefrom through an opening in the closed lower end 16 of the golf bag 12 to an interior of the golf bag 12. Note FIG. 2. The shaft 30 has an open upper end 32. The shaft 30 has a pair of apertures 34 therethrough in a spaced relationship along a vertically linear axis. Note FIG. 3.

The handle portion 36 has a T-shaped configuration defined by a lower vertical segment 38 and an upper horizontal segment 40. The lower vertical segment 38 is slidably received within the open upper end 32 of the shaft 30. Note FIG. 3.

The spring-locking mechanism is comprised of a tubular protrusion 42 that is disposed within and extends outwardly of the lower vertical segment 38 of the handle portion 36 for selectively engaging an upper most of the pair of apertures 34 of the shaft 30 in an extended orientation and a lowermost of the pair of apertures 34 in the closed orientation. The spring-locking mechanism includes a release button 44 disposed within an end of the upper horizontal segment 40 of the handle portion 36 whereby depressing the release button 44 will cause the tubular protrusion 42 to move inwardly of the lower vertical segment 38 thereby disengaging one of the pair of apertures 34 to allow the lower vertical segment 38 to slide with respect to the shaft 30. Once the handle portion 36 is in the extended orientation, the pair of wheels 26 can be lowered outwardly of the peripheral shell 22 so that the golf bag 12 can be rolled along a recipient surface by pulling on the handle portion 36.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A golf bag having retractable wheels and handle for allowing a golf bag to convert into a golf bag with wheels so as to transport golf clubs without carrying comprising, in combination:

a golf bag having a generally rectangular configuration, the golf bag having an open upper end and a closed lower end, the golf bag including a shoulder strap and a carrying handle, the closed lower end having a peripheral shell extending downwardly therefrom, the peripheral shell having an open lower end;

a pair of wheels retractably disposed within the peripheral shell of the golf bag in a closed orientation, the pair of wheels having an axle disposed therebetween, a shaft secured to a central portion of the axle and extending upwardly therefrom through an opening in the closed lower end of the golf bag to an interior of the golf bag, the shaft having an open upper end, the shaft having a pair of apertures therethrough in a spaced relationship along a vertically linear axis;

a handle portion having a T-shaped configuration defined by a lower vertical segment and an upper horizontal segment, the lower vertical segment being slidably received within the open upper end of the shaft;

a spring-locking mechanism comprised of a tubular protrusion disposed within and extending outwardly of the lower vertical segment of the handle portion for selectively engaging an uppermost of the pair of apertures of the shaft in an extended orientation and a lowermost of the pair of apertures in the closed orientation, the spring-locking mechanism including a release button disposed within an end of the upper horizontal segment of the handle portion whereby depressing the release button will cause the tubular protrusion to move inwardly of the lower vertical segment thereby disengaging one of the pair of apertures to allow the lower vertical segment to slide with respect to the shaft.

2. A golf bag having retractable wheels and handle for allowing a golf bag to convert into a golf bag with wheels so as to transport golf clubs without carrying comprising, in combination:

a golf bag having a peripheral shell extending downwardly therefrom, the peripheral shell having an open lower end;

a pair of wheels retractably disposed within the peripheral shell of the golf bag in a closed orientation;

a handle portion having a T-shaped configuration defined by a lower vertical segment and an upper horizontal segment, the lower vertical segment being coupled with respect to the pair of wheels;

a spring-locking mechanism selectively locking the handle portion with respect to the pair of wheels.

3. The golf bag having retractable wheels and handle as set forth in claim 2 wherein the golf bag includes a shoulder strap and a carrying handle.

4. The golf bag having retractable wheels and handle as set forth in claim 2 wherein the pair of wheels have an axle disposed therebetween, a shaft secured to a central portion of the axle and extending upwardly therefrom through an opening in the closed lower end of the golf bag to an interior of the golf bag, the shaft having an open upper end, the shaft having a pair of apertures therethrough in a spaced relationship along a vertically linear axis.

5. The golf bag having retractable wheels and handle as set forth in claim 4 wherein the lower vertical segment of the handle portion is slidably received within the open upper end of the shaft.

6. The golf bag having retractable wheels and handle as set forth in claim 4 wherein the spring-locking mechanism is comprised of a tubular protrusion disposed within and extending outwardly of the lower vertical segment of the handle portion for selectively engaging an uppermost of the pair of apertures of the shaft in an extended orientation and a lowermost of the pair of apertures in the closed orientation, the spring-locking mechanism including a release button disposed within an end of the upper horizontal segment of the handle portion whereby depressing the release button will cause the tubular protrusion to move inwardly of the lower vertical segment thereby disengaging one of the pair of apertures to allow the lower vertical segment to slide with respect to the shaft.

* * * * *